United States Patent [19]

Siegal

[11] 4,152,980

[45] May 8, 1979

[54] ROTARY MARKING DEVICE FOR SUCCESSIVELY IMPRINTING INFORMATION UPON CONVEYED ARTICLES

[75] Inventor: Burton L. Siegal, Skokie, Ill.

[73] Assignee: Kiwi Coders Corporation, Wheeling, Ind.

[21] Appl. No.: 767,630

[22] Filed: Feb. 10, 1977

[51] Int. Cl.[2] ..... B41F 17/26

[52] U.S. Cl. ..... 101/35; 101/329

[58] Field of Search ..... 101/35, 375–377, 101/328–331, 36, 37

[56] References Cited

U.S. PATENT DOCUMENTS

| | | | |
|---|---|---|---|
| 2,638,673 | 5/1953 | Burckel | 101/329 X |
| 2,691,936 | 10/1954 | Farkas et al. | 101/35 |
| 2,746,380 | 5/1956 | Gottscho | 101/35 |
| 2,901,968 | 9/1959 | Gottscho et al. | 101/35 |
| 3,001,628 | 9/1961 | Rice, Jr. | 197/52 |
| 3,021,783 | 2/1962 | Casey | 101/35 |
| 3,092,019 | 6/1963 | Van Buskirk | 101/35 |
| 3,179,043 | 4/1965 | Mellison | 101/35 |
| 3,208,375 | 9/1965 | Worth | 101/35 |
| 3,220,341 | 11/1965 | Price, Jr. | 101/35 |
| 3,327,624 | 6/1967 | Beaver | 101/35 |
| 3,624,730 | 11/1971 | Gottscho | 101/35 |
| 3,808,970 | 5/1974 | Delligatti | 101/35 |

*Primary Examiner*—Clifford D. Crowder

*Attorney, Agent, or Firm*—Silverman, Cass & Singer, Ltd.

[57] ABSTRACT

A rotary imprinting device for imprinting information on articles passing successively spaced along a given path and including a frictionally driven imprinting wheel provided with a planetary repositioning mechanism for returning the wheel to its initiate condition after an imprint has been effected and the wheel is released from the article. The repositioning mechanism is adjustable to change the null conditions of the wheel relative to the given start condition thereof. A slot and key coupling is described between the drive means, the means holding the imprinting type and the imprinting wheel, to prevent relative shifting thereof as the imprinting wheel is rotated.

36 Claims, 9 Drawing Figures

FIG. 3
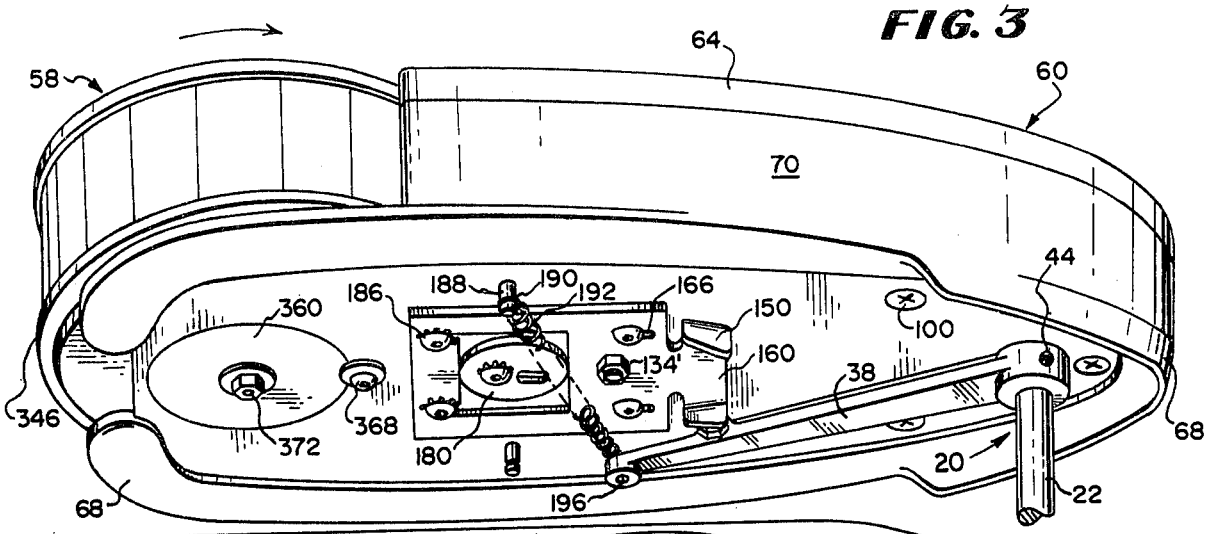
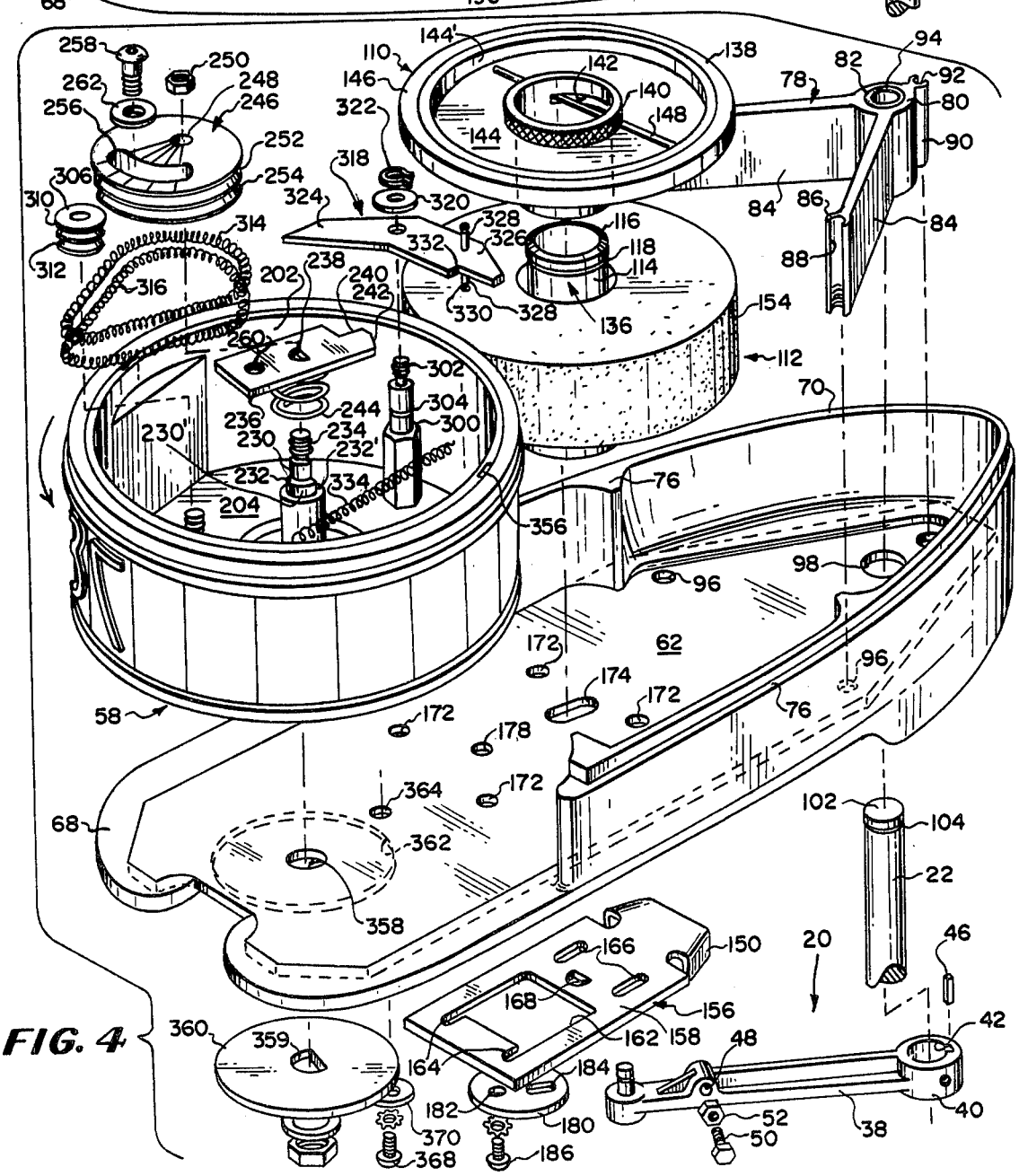
FIG. 4

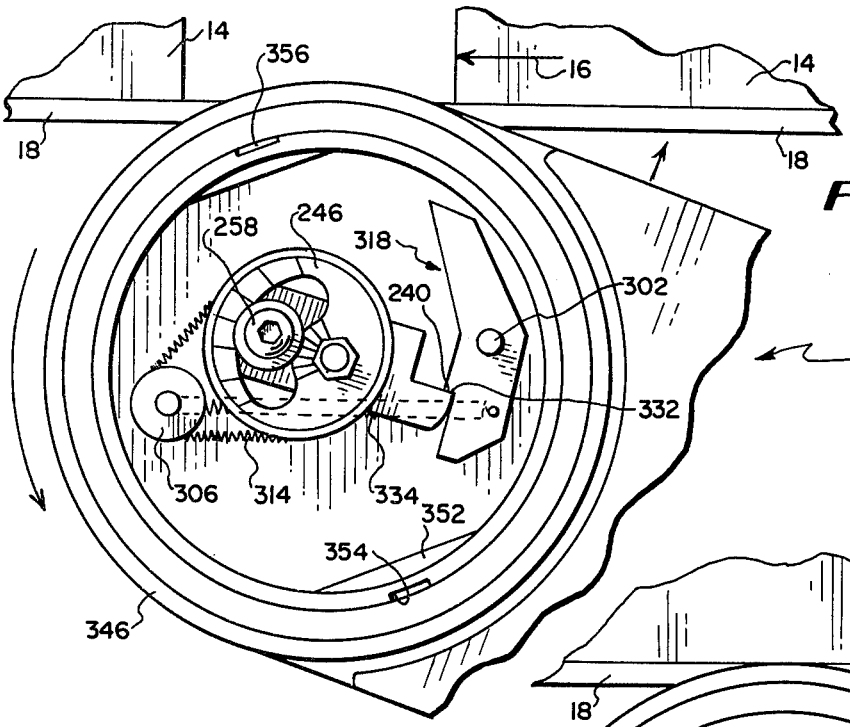
FIG. 7
FIG. 8
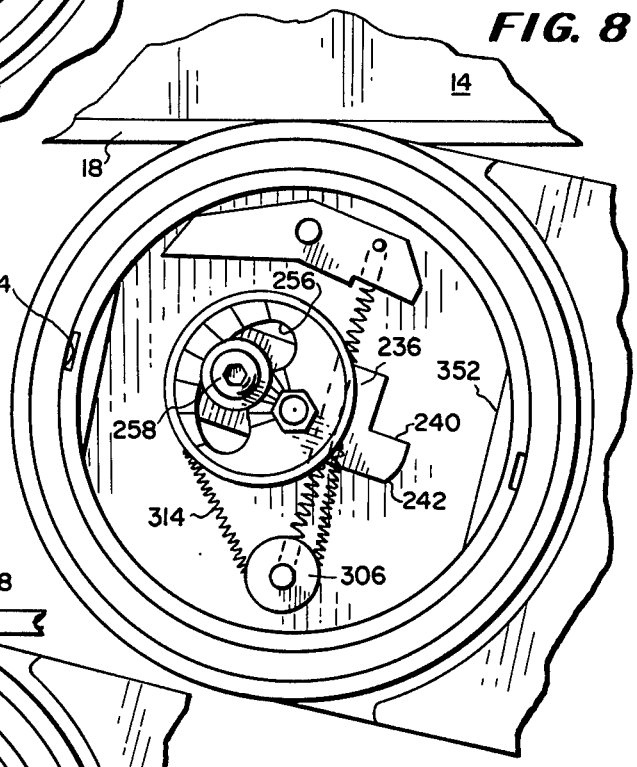
FIG. 9
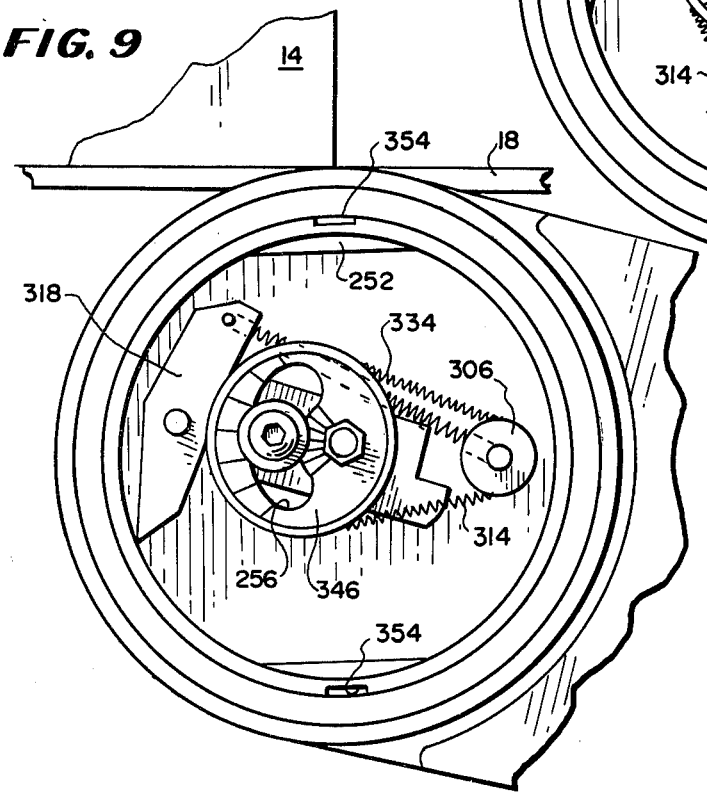

ROTARY MARKING DEVICE FOR SUCCESSIVELY IMPRINTING INFORMATION UPON CONVEYED ARTICLES

BACKGROUND OF THE INVENTION

This invention relates generally to devices for imprinting information upon packages, cartons and the like as they travel successively spaced along the reach of a conveyor. More particularly, the invention provides an improved rotary carton marking device including an improved quick-coupled, friction driven inking wheel and a friction driven imprinting wheel provided with improved return mechanism automatically to bring the imprinting wheel to its starting condition upon release from the package and before the next package is intercepted.

Known devices capable of imprinting information upon packages, cartons and the like conveyed spaced along a given path along the reach of a conveyor are generally of complex construction with accompanying expense. Difficulty is encountered in establishing access for maintenance. With many devices of this type known to the art, the frequency of service rate is high due to high incidence of fatigue of many of the mechanisms and elements thereof. Known devices of this type have minimal versatility both as to the handling of articles of many different sizes and as to the orientation of the device for use with different conveyor systems.

Known devices generally were not compact and often were mounted to an open plate or the like so that they were subjected to much dust, grease and other foreign materials reducing their useful life, increasing downtime and increasing the frequency of repair and/or replacement.

Often different size or length packages are encountered in commercial use and an imprinting device which must be changed from package size to package size is not as commercially desirable as would an imprinting device easily adjustable for different size packages. Mounting of the article marking device on one side or the other of a conveyor, as well as positioning same to mark either the tops or bottoms of the packages demand versatility in mounting. Registration control is important and a marking device should be adjusted to effect registration of the imprint at a precise location upon the article without complexities and undue difficulty is highly desirable. Often access is difficult for making such adjustment.

Among other problems encountered with some known devices are difficulty in handling, as for removal and/or replacement of the inking wheel necessitating handling of the ink impregnated roller associated therewith; and difficulty encountered in returning the unit to a given orientation in relationship with the conveyor apparatus once the unit had been removed from its installed condition for maintenance and/or other servicing.

Another problem for which solutions have been offered by known devices of this general type involve the provision of mechanisms by which the rotary imprinting wheel positively is returned to a given starting position after each article moves beyond the imprinting wheel. Some conventional mechanisms involve use of tension springs expanded by the activity of the imprinting wheel and contractable to force the imprinting wheel to return. Cam and spring biased follower means also were suggested. One known device utilized a stationary latch means mounted on a fixed base and coupled to a roller movable with the imprinting wheel and having an endless spring coacting with said roller and the drive means for the imprinting wheel to be actuated in response to the rotation of the rotary roller for automatically positioning the roller and the drive means at a predetermined angular position so long as the drive means had been turned through a predetermined minimum initial increment by engagement thereof with the article moving along the conveyor.

The last mentioned device provided an endless spring which, in addition to being extended about a rotor rotatably movable with the imprinting wheel, that is the drive means therefor, and a shaft secured to a latch plate carrying latch means, the spring also is extended about a roller mounted upon a stationary mounting plate. The mounting plate carries upstanding pins which are positioned slidably to engage the spring whereby to provide an angular latching bias which is necessary to establish a positive latched starting condition. One considerable problem encountered during use of such known device involves rapid fatigue and wearing of the spring and pins. Flat portions are formed on both the spring and the pins.

The length of the article being imprinted determines the degree of rotation of the imprinting wheel. It is desirable that the imprinting wheel completes a revolution before engaging the next package. One reason for this is to reduce the wear on the inking means supplying ink to the imprinting means carried by said imprinting wheel. Where the wheel repeatedly returns to its start condition without completing a full revolution, wear is encountered at one location about said inking means.

Moreover, the rotation of imprinting wheel say through approximately 150° to 180° from its initial position, is required to assure that the spring is effective automatically to whip the wheel to its starting position. During rotation, positions are reached where the roller assumes a balance or null condition. Once the roller turns through the null position, the spring self-acts to force full rotation of the printing wheel. The influence of the spring is felt even where rotation has occurred through approximately 150°. A minimum angular rotation of the printing wheel is required to return the wheel to its given starting position.

The location of the null condition is generally fixed and not adjustable, so that the minimum length of an article whose release is capable of returning the imprinting wheel to its given initial condition cannot be changed. It would be advantageous commercially to improve upon the versatility of such device by providing adjustment capability as to the minimum length of article with which the unit can be utilized, considerable reduction of fatigue upon the spring, improved versatility for use with conveyors moving at both slow and high speed, assurance of return to the given location with rotation of less than the assumed minimum degree of rotation and, as well, provide improvements to the construction and operation of the other components of such device leading to compactness so that minimal space is occupied at the conveyor, ease of operation and maintainence, reduction of costs and weight to enhance portability and to increase the ease of assembly, disassembly and adjustment, and to eliminate relative angular slippage of the imprinting means carried by the imprinting wheel as well as to materially reduce the tendency, encountered in many devices, of the imprinting wheel to be loosened during its frictional rotation.

SUMMARY OF THE INVENTION

In a friction driven rotary article marking device for applying imprinted information upon articles such as packages, cartons and the like as same travel spaced apart successively along the path of a conveyor past said device and including a friction driven imprinting wheel, a friction driven inking wheel capable of applying ink to said imprinting wheel, a spring biased base plate and means coupling said imprinting and inking wheels to said base plate for free rotation of said wheels about their respective axes, drive means carried by said imprinting wheel, means mounting said base plate pivotally to place said drive means into the path of said articles so as individually to intercept same and rotate along said article thereby to rotate said imprinting wheel continuous with such engagement and means defining a given starting location of said imprinting wheel; the improvement comprising a spring-biased sun and planet arrangement for returning said imprinting wheel to said given location independent of the degree of rotation of said imprinting wheel and operable upon the disengagement of said imprinting wheel from said article.

The invention contemplates as well, a slot and key coupling between the type carriers seated upon the imprinting wheel; means for adjusting the torque applied to the spring biasing said sun and planet arrangement; quick-coupling means for the inking wheel so that the inking wheel may be removed from the base plate without touching the inking ring carried thereby; means for easily adjusting the center to center distance between the inking and imprinting wheels; and means enclosing the operating elements of said return mechanism within said imprinting wheel.

According to the invention, the sun and planet arrangement comprises a stationary sun disc seated eccentrically at the axis of rotation of the imprinting wheel, a planet wheel secured to the interior of said imprinting wheel for movement along a generally circular path with the rotation of the imprinting wheel and at least one endless spring looped about said sun disc and planet, said sun disc secured to a stationary latch member, a pawl member secured within said imprinting wheel for movement with rotation thereof simultaneous with movement of said planet and spring means biasing said pawl member into intercepting engagement with said stationary latch member to intercept and engage said latch member positively at the predetermined starting location.

The invention also provides means for adjusting the relative position of the sun disc and the planet wheel to change the location of the null or balance conditions of the planet wheel relative to the latch. An arcuate slot is provided in the sun disc and a releasable fastener secured in said slot, loosening of the fastener permitting rotation of the disc about its eccentric axis within the limits provided by the slot.

The invention further provides releasable bracket means for adjusting the relative distances between the axes of rotation of the printing and inking wheels. There is provided a spider mounting member to provide a stable support for the device as well as a molded housing for the device including a metal base plate as a part of the housing.

DESCRIPTION OF THE DRAWINGS

FIG. 3 is a perspective view of the article marking device of FIG. 1 taken looking upward at the bottom of said device.

FIG. 4 is an exploded perspective view of the device of FIG. 1 illustrating the manner of assembling said device.

FIG. 7 is a diagrammatic top plan view of the inking wheel, said wheel shown in the latched or start condition just prior to engagement thereof with the article to be imprinted.

FIG. 8 is a diagrammatic top plan view similar to that of FIG. 7 but with the printing wheel illustrated during imprinting of the article.

FIG. 9 is a diagrammatic top plan view similar to that of FIG. 7 and FIG. 8 but illustrating the printing wheel released from the article but with the return mechanism in the so called null or dead zone—at a balanced condition.

DESCRIPTION OF PREFERRED EMBODIMENT

Figure 1:
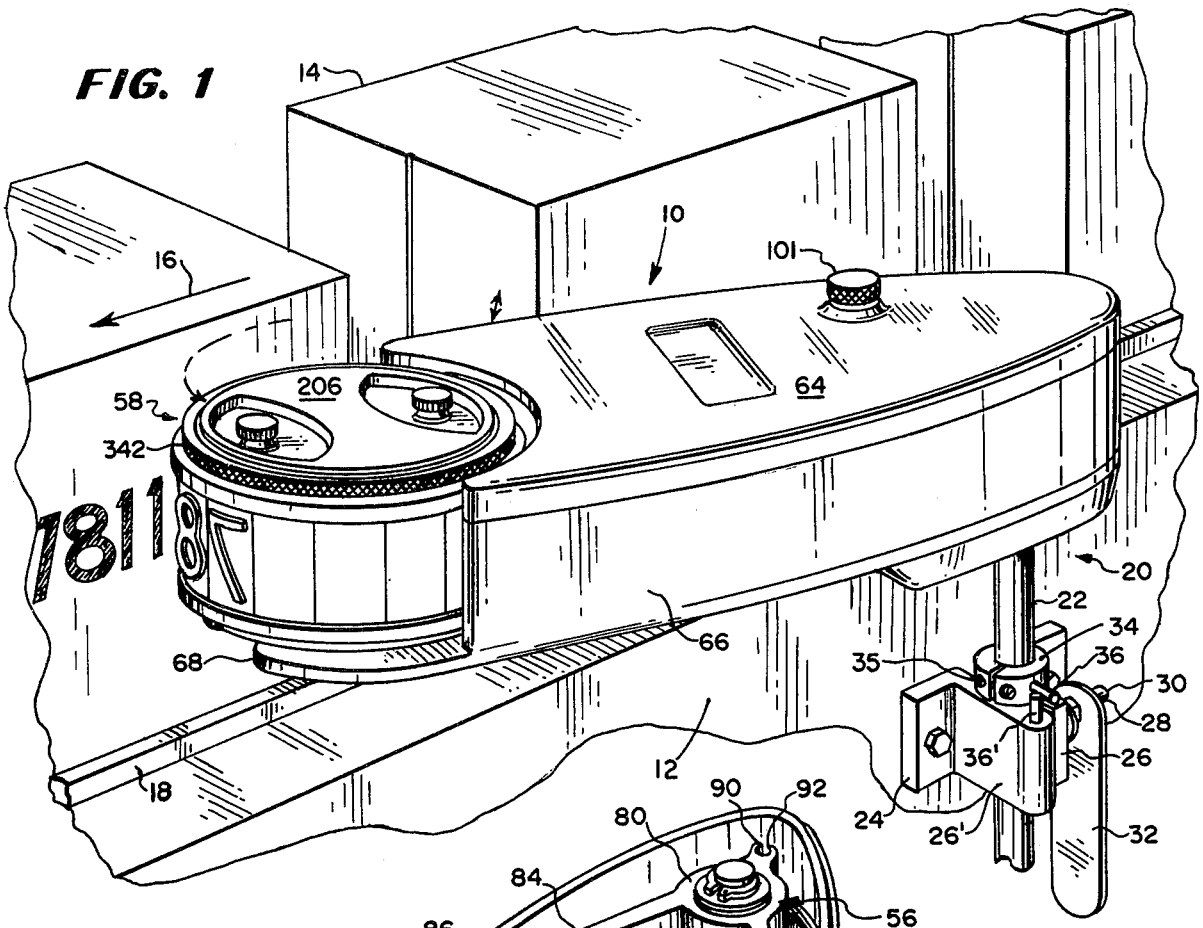
FIG. 1 is a perspective view of the rotary article marking device according to the invention illustrated as installed upon a conveyor and engaged with an article as it travels with others spaced one from the other during the process of applying an imprint to the surface thereof.

Referring now to the drawings, and particularly FIG. 1 thereof, the rotary article marking device according to the invention is designated generally by reference character 10 and is mounted to frame 12 of a conveyor along which articles 14 travel spaced apart in a direction indicated by arrow 16 guided therealong by guide rails 18. A minimum spacing of 2 to 4 inches between articles normally is encountered.

The device 10 includes support means 20 capable of pivotal movement for intercepting each of said articles 14. Support means 20 include a stationary shaft 22 about which the device 10 pivots, which shaft is secured removably to clamping bracket 24 in turn secured to the side frame 12. The clamping bracket 24 has a pair of spaced arms 26, 26' capable of being urged together by a capped bolt 30. A captive flat wrench 32 is seated upon cap 28 of bolt 30. The wrench 32 is retained upon said cap 28 by a washer and snap ring (not shown) secured inward of the cap end of bolt 30. The wrench 32 functions as a lever which can be utilized to release the shaft 22 or to clamp the shaft 22 at a location assuring proper horizontal alignment of the device 10 with the articles 14 for application of an imprint at the desired location on the article surface.

A split collar 34 is secured on the shaft 22 by socket screw 35 and can be located at a position along the shaft 22 for installing the device 10 at the desired height for proper horizontal alignment when the shaft 22 is removed from the clamping bracket 24, as for service. When the shaft, etc. is reinstalled, the collar 34 rests on the arms 26, 26' of clamping bracket 24. The collar 34 carries a radially outwardly extending pin 36. One arm 26' of the clamping bracket 24 carries an upstanding pin 36'.

The shaft 22 is passed between the arms 26, 26' of the clamping bracket 24 and the said arms tightened thereabout when the desired height of the device 10 from the floor has been determined to assure proper horizontal alignment of the device 10 for proper imprinting of the articles 14. The collar 34 is loosened and rotated relative to the shaft 22 to bring the pin 36 to bear against pin 36'. The collar 34 is tightened onto the shaft 22. Now, the clamping bracket 24 can be loosened and the device 10 can be removed along with the shaft 22, say for service, etc. When the device 10 and shaft 22 is returned for installation, the correct height and orientation of said device 10 is assured, the position of the collar 34 along the length of the shaft 22 determining the height of the device 10 and the bearing engagement of the pins 36 and 36' assuring proper orientation of the device 10 relative to the conveyor and the articles traveling therealong.

Referring to FIGS. 3 and 4, the support means 20 also includes an elongate support arm 38. Arm 38 has an enlarged collar formation 40 carrying passage 42 for receiving the shaft 22 therethrough. The collar formation 40 is secured to the shaft 22 by a suitable set screw 44 and keyed thereto by Woodruff key 46 (as shown in FIG. 4). The arm 38 also is formed with a through threaded cross-bore 48 adapted to receive a stop bolt 50 from either side thereof, as shown in FIG. 4. A hex nut 52 is engaged on bolt 50 between its head and the arm 38 to serve as a jam to prevent loosening of bolt 50. The stop bolt 50 may be adjusted along the passage 48 to space the head thereof at a variable distance from arm 38.

The device 10 includes, in addition to the support means 20, a friction driven inking wheel assembly 54, a mounting assembly 56, a friction driven imprinting wheel assembly 58 and a housing 60 therefor. The housing 60 includes a metal base plate 62 preferably formed as an aluminum alloy extrusion, and a removable cover 64 extending over all but a fraction of the base plate 62. The inking wheel assembly 54 and the mounting assembly 56 are secured to the base plate 62 within the covered area, while the imprinting wheel assembly 58 is secured onto the base plate 62 at the uncovered area thereof.

The housing 60, as stated, includes the metal base plate 62 and a plastic molded body 66 molded onto the base plate 62 so as to form a permanent utilized assembly. The body 66 includes a shield portion 68 coextensive with the edge of the base plate 62 and encapsulating same, and an upstanding wall 70 which extends in a U-configuration along the shield portion 66 for a substantial portion thereof leaving a section of said base plate 62 without a wall. The wall 70 terminates in a pair of opposite end posts 72 having generally curved end surfaces 74. An outer ledge 76 is formed along the top of wall 70 coextensive therewith to accommodate the cover 64 in a mating engagement. Suitably thickened ribs 76 likewise are formed as a part of wall 70 to supply additional strength along said wall 70.

The base plate 62 is machined to provide passageways and mounting points at selected locations therein. These will be discussed hereinafter in connection with the elements mounted thereto.

Attention now is directed to the mounting assembly 56 which is formed, preferably, as a single unitary extruded or cast spider formation 78 having a cylindrical hub 80 carrying through passageway 82 and a pair of outwardly divergent legs 84. Each leg 84 extends along the axial length of hub 80 coextensive thereof and terminates in an enlarged post 86. Each post carries an outwardly opening threaded groove 88 along the length thereof. A third post 90 is formed along the axial length of hub 80 also coextensive therewith and located equidistant from legs 84. The post 90 also carries a threaded, outwardly opening groove 92, the axes of posts 86 and 90 being parallel to each other and to the axis of hub 80. A pair of cylindrical self-lubricating bearings 94 are interference-fitted into opposite ends of passageway 82 of hub 80 and flush with the openings thereof. The inner diameter of said bearings 94 is selected rotatably to accommodate the shaft 22, the assembly 56 being capable of pivotal movement about said shaft.

Three like, countersunk mounting passageways 96 are formed in a generally triangular array in the base plate 62 closely adjacent the shield portion 68 of body 66 and symmetrically arranged near the U of wall 70. A passage 98 also is formed in the base plate 62 and has an inner diameter selected to accommodate the shaft 22 therethrough with adequate clearance. The spider formation 78 is secured within the housing 60 by engaging screws 100 in grooves 88 and 92. The spider formation 78 is located at the crook of the U of wall 70, with the grooves 88 opening toward ribs 76 and groove 92 opening toward the crook of the U of wall 70, the grooves 88 and 92 being aligned with the passageways 96. The hub 80, legs 84 and post 90 resting upon the base plate 62 defines a three point stance of considerable stability. A thumb screw 101 with a knurled head can be passed through a suitable opening in the cover 64 and engaged within the upper end of one groove 88 securing the cover on the body 66.

Figure 5:
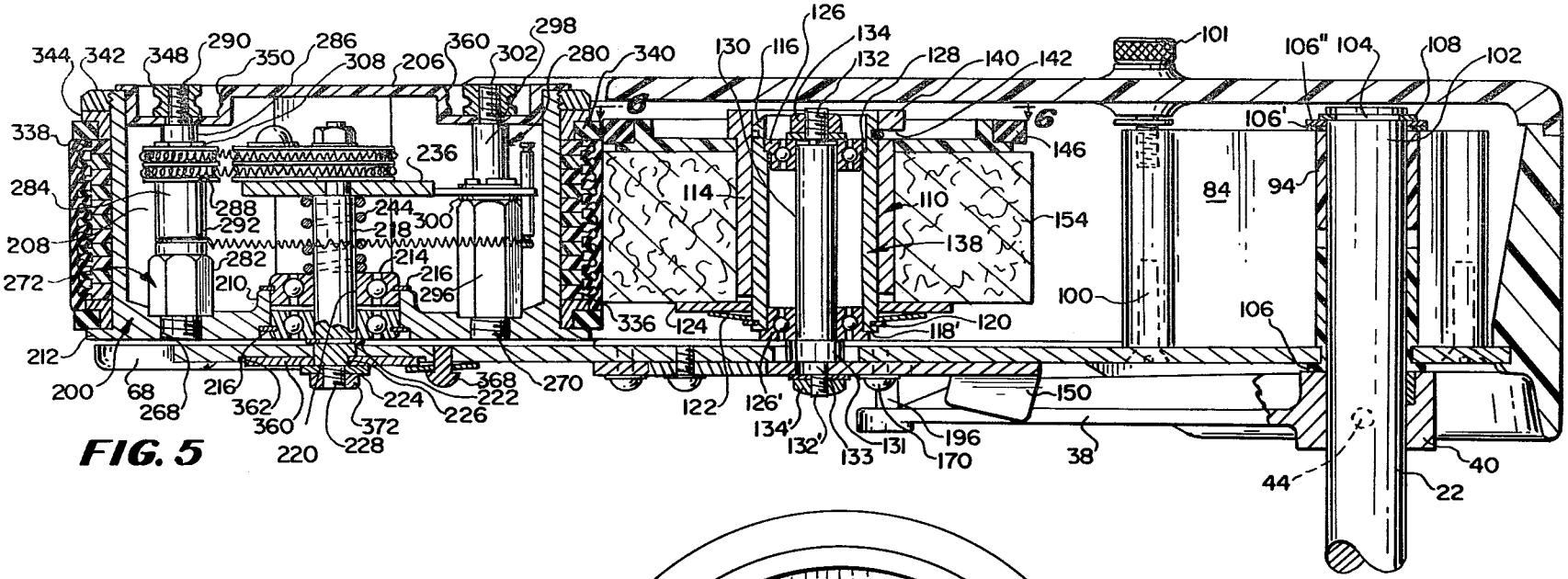
FIG. 5 is a horizontal sectional view taken longitudinally through the article marking device of FIG. 1.

The shaft 22 is assembled to the spider formation 78 by passing the upper end 102 thereof through passageway 42 of collar formation 40 formed on arm 38. A Nylon washer 106 is slipped over the end 102 of shaft 22. The shaft is fitted through the bearings 94 to terminate extending outwardly of the upper one of said bearings 94. The end 102 of the shaft 22 carries annular groove 104. Suitable washers, including a Nylon washer 106' and steel washer 106", are slipped over the end 102 and a snap ring 108 is seated within groove 104 to retain the end 102 in place (FIG. 5).

The driven inking wheel assembly 54 is installed within the housing 60 at a location intermediate the open end of wall 70 and the mounting assembly 56. Referring particularly to FIGS. 4 and 5, the inking wheel assembly 54 comprises a spindle assembly 110 and an inker drive wheel assembly 112 capable of being mounted to said spindle assembly 110.

The spindle assembly 110 includes a hollow cylindrical tubular spindle 114 having a chamfered upper end 116. An outer circumferential groove 118 is formed in the outer wall of the spindle 114 closely adjacent the chamfered end 116. A second annular groove 118' is formed in the outer circumferential wall of spindle 114 adjacent the end thereof opposite the chamfered end 116. The groove 118' accommodates a snap ring 120 which serves as a seat for loosely mounted finger washer spring 122. A large diameter washer 124 is seated upon the finger washer spring 122 and functions to support the inker ring 154 of the inker drive wheel assembly 112. The inker ring 154 will be described hereafter.

A pair of flanged ball bearings 126 and 126' are interference fitted into the opposite ends of spindle 114, bearing 126 resting on an annular ledge 128 formed in the inner wall of the said spindle 114 spaced from the chamfered end 116. A cylindrical axle 130 having an enlarged portion 131 is passed through the bearings 126 and 126', with bearing 126' resting on the shoulder defined by portion 131. The axle 130 has opposite threaded ends 132, 132' to accommodate hex nuts 134, 134'. Nut 134 functions as a bearing retainer in cooperation with the enlarged portion 131. Between end 132' and the enlarged portion is a flatted portion 133.

The inker drive wheel assembly 112 includes a hollow cylindrical hub 136 and a drive wheel 138. The hub 136 is provided with an enlarged knurled annular rim 140. An chordal cross-slot 142 is cut through the rim 140. The drive wheel 138 is formed as a ring disc 144 on which is molded a tire member 146 of soft natural rubber (e.g. of 25–30 durometer in hardness). A length of spring wire 148 is arranged across the ring 144, end 148' of said wire being molded into the tire member 146 and the opposite end 152 of said wire being spaced from the rim 144' of the ring disc 144. The wire 148 is oriented so that it extends across the central opening of ring disc 144 from the inner edge thereof. The ring disc 144 is interference-fitted onto the hub 136 so that the wire 148 passes through the slot 142 to cross the bore of said hub 136 closely adjacent the inner wall thereof. An annular inking ring 154 of ink-impregnated cellular material is mounted slidably upon the hub 136 and retained axially thereupon by washer 124.

Figure 6:
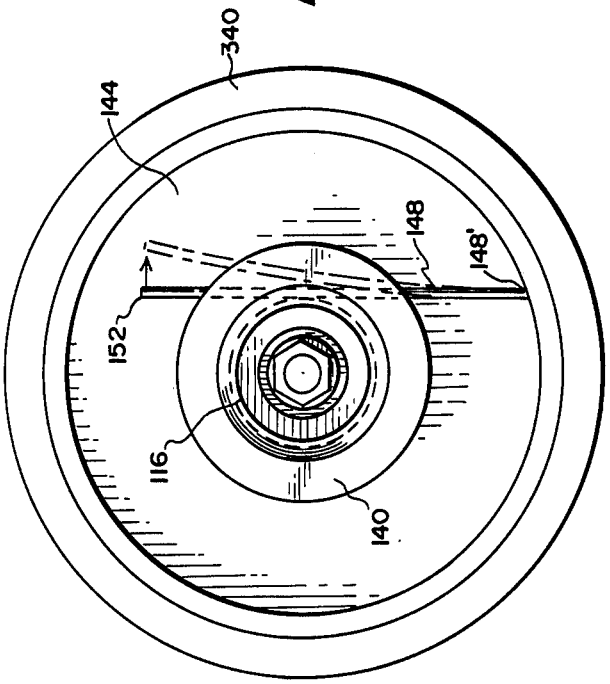
FIG. 6 is a top plan view of the inking wheel assembly of the device of FIG. 1 particularly illustrating the quick-coupling mechanism for assembling the inking wheel to the base plate of the housing for said device.

The spindle assembly 110 first is mounted to base plate mounting bracket 156 which is secured to the underside of the base plate 62. The inker drive wheel assembly 112 then is assembled to the spindle assembly 110 by sliding the hub 136 thereof over the spindle 114 past the chamfered upper end 116 pushing against the bias of finger washer spring 122. In passing, the wire spring 148 is cammed outward and, once past the chamfer, snaps back to rest in the groove 118 of the spindle 114. (FIG. 6)

The inker drive wheel assembly 112 may be disassembled from the spindle assembly 110 by grasping the knurled rim 140 and lifting same simultaneously urging wire end 152 radially outward so that the wire 148 clears the annular groove 118. Once the wire 148 is freed from said groove 118, it is cammed along the chamfered end 116, aided by the bias of the finger washer spring 122 so that the inker drive wheel 102, with the inking ring 154, can be lifted slidably off the spindle 114 without touching the inking ring itself.

The base plate mounting bracket 156 additionally functions to provide stop means for limiting the angular spring biased pivotal movement of said device 10. The said bracket 156 also functions to enable the axial distance between the inking wheel assembly 54 and the imprinting wheel assembly 58 to be fine adjusted.

The base plate mounting bracket 156 comprises a generally flat plate member 158 of generally rectangular configuration having an extension 160 coplanar therewith. The extension 160 is provided with a pair of upstanding wings or lugs 150 disposed normal to the extension but in relatively converging vertical planes. A large, generally rectangular opening 162 is formed in plate 158 at a location spaced inwardly of the end of the plate opposite to the extension 160. A pair of parallel slots 164 are formed in said plate 158 at the corners of opening 162 and open into said opening 162. A second pair of aligned slots 166 are formed in plate 158 adjacent its corners nearest the lugs 150 and a D-shaped opening 168 is formed between the slots 166 but offset therefrom in the direction of the opening 162 with the arcuate edge of said opening 168 directed toward said rectangular opening 162. The bracket 156 is secured to the underside of base plate 62 by socket screws 170 carrying locking washers and passed through slots 164 and 166 and then through openings 172 formed in said plate 62. The passage 168 in plate 158 is aligned with large passage 174 of the base plate 62 and the end 132' of axle 130 is passed through passage 174 and passage 168 and secured by hex nut 134'.

A threaded passage 178 formed in the base plate 62 is framed by the rectangular opening 162 of bracket 156. A disc 180 is seated within the opening 162 when the bracket 156 is secured upon the underside of base plate 62. Disc 180 carries an offset or eccentric passage 182 and a radial slot 184 located between the passage 182 and the circumferential edge of said disc. Socket screw 186 with a locking washer is used to secure the disc 180 to the underside of the base plate 62, through eccentric passage 182 of said disc. In order to change the center to center distance between the inking wheel assembly 54 and the imprinting wheel assembly 58, it is only necessary to loosen socket screws 170 and 186. The disc 180 then can be rotated, say by use of an instrument in slot 184, to cam the bracket 156 either toward or away from the imprinting wheel assembly 58, and screws 170, 186 retightened.

The lugs 150 are positioned in the path of the stop bolt 50 and are of sufficient dimension to intercept the stop bolt 50 notwithstanding the movement of the base mounting bracket 156 between its extreme positions. A pair of depending pins 188 are seated forcibly in the base plate on opposite sides of the mounting bracket 156, each pin 188 having retainer grooves 190 adjacent its free end. One end of a helical coil spring 192 is anchored in the retainer groove 190 of one of the pins 188, with the opposite end of said spring 192 being anchored in a retainer groove not shown formed in pin 196 secured at the free end of support arm 38. Spring 192 is selected of sufficient strength to provide the bias necessary to permit limited pivotal movement of said device 10 against its bias upon the interception of an article 14, and to urge the imprinting wheel assembly 58 against the surface of the article being imprinted with sufficient force frictionally to drive the printing wheel assembly as the article 14 moves along the conveyor. The inking wheel assembly 54 simultaneously is driven by engagement of the respective drive wheels of each with the other. Thus ink is applied to imprinting means carried by the imprinting wheel assembly 58.

Figure 2:
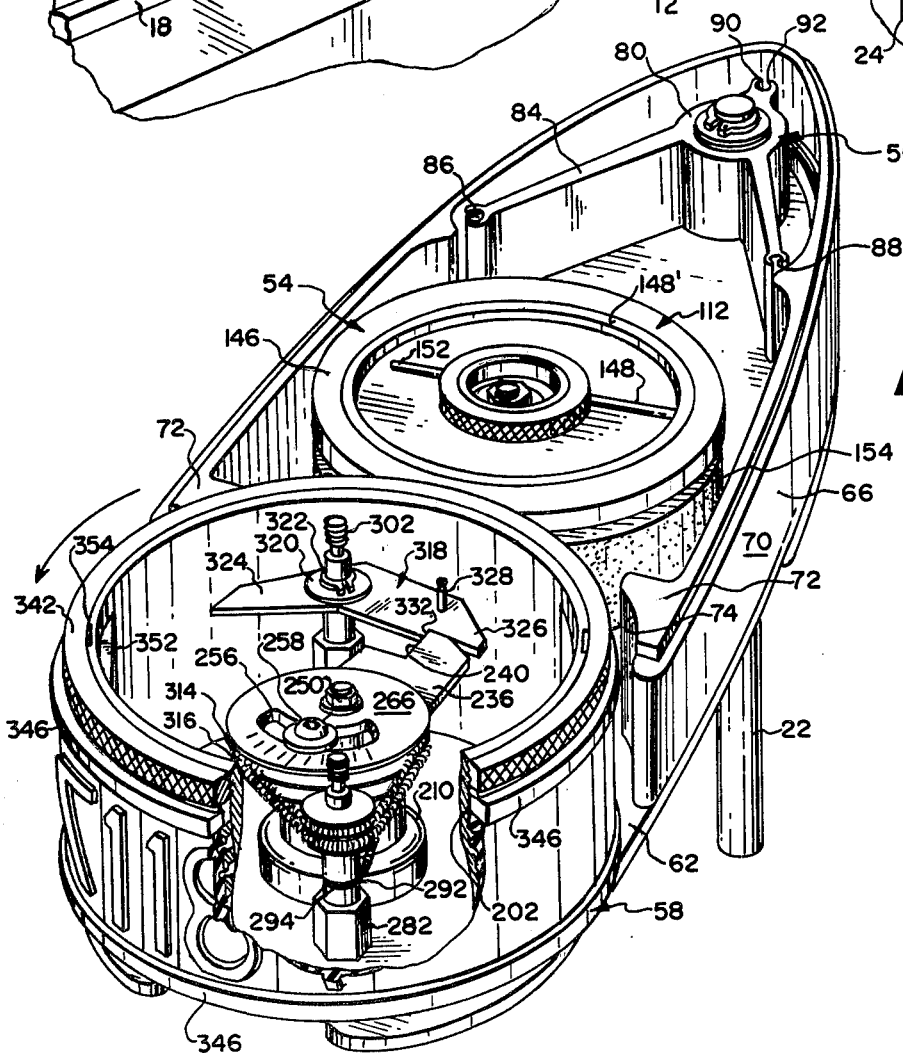
FIG. 2 is a perspective view looking downward at the article marking device of FIG. 1, said article being shown with the cover removed, portions being cut away to illustrate interior detail.

Attention now is directed to FIGS. 2, 4 and 5 wherein the driven rotary imprinting wheel assembly 58 is shown seated for free rotation upon the base plate 62 at a location thereon not surrounded by wall 70 with the outermost extending circumferential portions of said assembly 58 clearing the arcuate surfaces 74 of posts 72 of wall 70.

The rotary imprinting wheel assembly 58 comprises a hollow, open-topped cylindrical body 200 defined by a tubular wall 202 and a floor 204. A removable cover 206 is provided for securement to the body 200 in a manner to be described so as to close off the body cavity 208 so that interior mechanisms contained therein are protected from dust and other extraneous foreign matter. The body 200 can be formed as a single casting.

The floor 204 is formed with an upwardly extending central hub 210. The body 200 is provided with a circumferential annular ledge 212. A pair of ball bearings 214 is seated within hub 210 and retained axially therein by snap rings 216. A cylindrical axle 218 is passed through the axial passage 220 defined by the inner race of bearings 214 and secured by snap ring 222 so that a portion 224 of the axle 218 extends outward of the underside of floor 204. Portion 224 carries a flat 226 and a reduced diameter threaded portion 228. As shown in FIG. 4, the opposite end of axle 218 has a first reduced diameter portion 230 and a second reduced diameter portion 230′ defining annular seats 232 and 232′. Portions 230 and 230′ have flats formed along the length thereof for a purpose to be described. A threaded stud portion 234 coaxial with axle 118 is formed at the free end of portion 230′.

A stationary flat latch plate 236 of generally rectangular configuration has a D-shaped passage 238 formed therein and is mounted upon the seat 232, the portion 230′ extending therethrough. The latch plate 236 is notched at one corner to define a latch 240 and is rounded at the adjacent corner to define a cam edge 242. The orientation of the flat of portion 230 and the D-shaped passage 238 is selected properly to orient the latch 240 and the cam edge 242 to engage a pawl which, as will be described, is mounted within the cavity 208 for movement with the imprinting wheel assembly 58. A helical compression spring 244 is seated between the latch plate 236 and the upper one of bearings 214 to preload the bearings.

A stationary sun disc 246 carrying an eccentrically located passage 248 is seated upon seat 232′ and secured fixedly in place by engaging hex nut 250 upon threaded stud portion 234. Sun disc 246 carries a pair of spaced circumferential grooves 252 and 254. The sun disc 246 also has an arcuate slot 256 which is radially spaced from passage 248 along an arc concentric therewith. Socket screw 258 is received through slot 256 and threadably engaged in passage 260 formed in latch plate 236. Flat washer 262 and internally threaded lock washer (not shown) are sandwiched between the head of screw 258 and the surface 266 of the sun disc 246.

A pair of threaded passageways 268 and 270 are formed in floor 204 at diametrically opposed locations spaced adjacent the wall 202. A stud 272 is threadably engaged within passage 268 and shall be referred to henceforth as the planet stud and a stud 280 is threadably engaged within passage 270 and shall be referred to henceforth as the pawl stud.

The planet stud 272 includes a hexagonal portion 282, a cylindrical portion 284 adjacent the portion 282, a reduced diameter shaft portion 286 adjacent portion 284 and defining a seat 288, and a threaded end portion 290. A circumferential groove 292 is formed in portion 284 to receive a snap-ring 294.

The pawl stud 280 also has a hexagonal portion 296 which is longer than portion 282 of stud 272, and adjacent thereto, has a reduced diameter cylindrical portion 298 defining a seat 300 and terminating in threaded stud 302. Portion 298 of stud 280 carries an annular groove 304.

A planet wheel 306 is mounted for rotation about shaft portion 286 of planet stud 272, said planet wheel 306 resting upon seat 288. A snap ring 308 is illustrated but is not necessary as the planet wheel is self retaining after complete assembly has been effected. The planet wheel 306 carries a pair of spaced circumferential grooves 310, 312. The seat 288 is located so that the grooves carried by the planet wheel 306 are aligned at the same level with the grooves 252 and 254 carried by the sun disc 246. A pair of like endless springs 314 and 316 are seated in the respective circumferential grooves of the planet wheel and the sun disc coupling same. Each of springs 314 and 316 is formed of tightly wound music wire, the ends of which are slightly tapered and "screwed together" to form each of said springs.

The planet wheel 306 moves with the rotation of the imprinting wheel assembly 58 along an orbital path about the stationary sun disc 246 and latch plate 236, as will be described, exerting tension on the springs 314 and 316 sufficient to return the imprinting wheel assembly 58 to a given starting position except between a limited minimum range of angular rotation where the tension of the springs is insufficient to cause the imprinting wheel assembly 58 to rotate one way or the other so that the imprinting wheel assembly 58 is not snapped back to its starting position when the article releases the drive wheel thereof. This range is known as a null or dead zone. The invention provides means whereby the location of the null zone may be adjusted, i.e., changed by simple adjustments, as will be described later.

The pawl 318 is mounted upon the seat 300 of pawl stud 280 and is secured in place, sandwiched between brass washers 320 by snap-ring 322. The pawl 318 includes a bearing arm portion 324 and a latch engaging arm portion 326. The latch engaging portion 326 carries a pin 328, having an annular circumferential groove 330 at opposite ends thereof. The latch engaging arm portion includes a notch 332 which engages the latch 240. The pawl 332 is biased by spring 334 to place the notch 332 in the path of the latch 240. One end of spring 334 is secured to pin 328 and the other secured to the apertures provided by snap ring 294 which is seated in groove 292 of the planet stud 272. The bearing arm 324 of pawl 318 is biased against the cylinder wall 202 to limit the inward excursion of latch engaging arm portion 326. The imprinting wheel assembly 58 is completed by the seating of the base-lock type holding rings 336 with type 338, and drive wheel rings 340 slidably upon the cylindrical wall 202 of the body 200 and threadably engaging the threaded retainer ring 342 onto the threaded outer circumferential portion 342 of the wall 202. The drive wheel rings 340 each comprises a ring 344 carrying a friction band or tire 346. The cover 206 is secured over the cavity 208 and fastened by engagement of knurled thumb nuts 348 onto the threaded portions 290 and 302 of the planet stud and pawl stud respectively. The cover 206 is provided with shallow recesses 350 to enable good purchase to be made with the thumb nuts 348.

As is apparent from the drawings, the cylindrical wall 202 of body 200 is provided with facing thickened inner wall portions 352 at diametrically opposed locations. Coextensive therewith, longitudinal grooves 354 are formed in the outer circumferential surface of the wall 202 coextensive with the portions 352.

Each of the type retaining rings 336 and the drive wheel rings 340 is formed with diametrically opposite opposed inwardly extending ribs 356 adapted to be slidably received within the grooves 354. The ribs 356 are engaged within the grooves 354 when these rings etc. are installed upon the body 200. In this way, the type retainers, etc. are locked against relative movement when assembled onto the body 200. This essentially slot and key connection prevents shifting of respective one of the type carriers, rings, etc. and hence the type faces as printing ensues. The slot and key connection also functions to transmit the torque during rotation of the wheel 58 directly to the wheel preventing inadvertent disassembly of wheel 58.

The operation of the imprinting wheel assembly 58 and particularly, the operation of the automatic return mechanism which comprises the planetary coupling (planet wheel 306, the latch 240, sun disc 246, the endless springs 314, 316 and the pawl 318) will be explained with reference to the illustrations of FIGS. 7–9.

The imprinting wheel assembly 58 is seated in passage 358 formed in the base plate 62. The portion 224 passes through passage 358 and through D-shaped passage 359 of washer 360 which is seated in a shallow recess 362 formed in the undersurface of the base plate 62. A passage 364 is provided in the base plate 62 adjacent the recess 362. A screw 368 supporting a washer 370 is threadably engaged within the passage 364. Nut 372 is engaged upon the portion 228 of axle 218 with a washer supported between the axle 218 and said nut. The screw 368 first is tightened and serves effectively as a wrench, holding the assembly in place while nut 372 is tightened. To effect adjustment of registration of the imprint upon the article, all that is required is disengagement of the nut 372, loosening of screw 368 and rotation of the imprinting wheel assembly as desired.

In FIG. 7, the imprinting wheel assembly 58 is illustrated in its start condition ready to intercept an article 14. The latch 240 is engaged by the latch engaging notch 332 of pawl 318. The normal or home location of the planet wheel 306 is selected to apply an angular bias of about 20° to 30° in a clockwise direction opposite relative to the direction of rotation of the imprinting wheel assembly 58 during printing. Thus, engagement of the latch 240 notch 332 is positive. As evident from the drawing, the rotary orientation of the sun disc 246 effectively determines the home location of the planet wheel. The screw 258 is seated in slot 256 midway between the ends thereof. Only about one half of the slot 256 is required for the adjustment of the null point, the remainder of the slot being provided for use should the marking device be assembled for opposite hand direction. In such case the disc 246 would be "flipped over" so that the other half of the slot would be used with the first mentioned half being unused. It should be clear that the adjustment screw 258 and slot 256 provides means, when the bolt 250 is loosened, to rotate the position of said disc 246 so as to increase or decrease the bias of the planet 306. Suitable embossed scale can be provided on the sun disc surface to provide reference for the operator. The device 10 is biased toward the conveyor by spring 192. The circumferential edge of the drive ring 340 of imprinting wheel 58 is placed in intercepting relation relative to the articles 14 traveling along the conveyor. When an article 14 is intercepted, the drive wheel engages the facing surface thereof and frictionally is rotated, the imprinting wheel assembly 58, simultaneously driving the inking wheel assembly, so that inked type carried by the rings 336 can bear against said to be imprinted surface of the article 14.

In FIG. 8, the imprinting wheel assembly 58 is illustrated in the process of imprinting information upon the intercepted article 14. The imprinting wheel assembly 58 has been rotated approximately about 90° from the start condition. The pawl has moved, as has the planet wheel. The sun disc and the latch plate remain stationary. If the imprinting wheel assembly were to be released from the article surface at this condition, the torque exercised by the position of the planet wheel relative to the sun disc would drive the imprinting wheel assembly clockwise to return the pawl 318 with the notch 332 engaged against latch 240. This is not desirable as undue wear is caused to the inking ring. Rotation of the imprinting wheel assembly 58 greater than about 150° would complete the revolution of the wheel assembly driving notch 332 against latch 240.

As is evident, the rotation of the imprinting wheel assembly 58 is controlled by the length of the article being imprinted. As the wheel assembly 58 rotates, the planet wheel 306 passes through two conditions at which there is insufficient torque applied to return the wheel assembly 58 to its starting latch condition. These conditions are referred to as null or dead zones and occur when the eccentric axis of the disc 246 and the centers of the disc 246 and planet wheel 306 lie in a straight line. The first of these null conditions occur when the endless springs 314, 316 have their maximum extension. With a wheel 58 having a circumference of sixteen inches, the first null occurs after a rotation of about 6.6 inches. Since the springs 314, 316 are at maximum extension, this null condition is sharp and can be overcome to a great extent by the inertia of the wheel.

The second null condition occurs where the endless springs 314, 316 are at their minimum extension, just short of the latched condition. This condition occurs, in the wheel described, when the wheel is rotated about 15 inches of its circumference and then released by the article. The second condition has a greater angular range. The invention provides means whereby the locations, relative to the latch, at which the null conditions occur can be shifted.

The first null condition is illustrated in FIG. 9. The endless springs 314, 316 are illustrated at their maximum extension.

The null condition denotes an inability to self-return on the part of the imprinting wheel assembly 58. Accordingly, it is desirable to shift the location of the null range relative to the latch and thus enable the device to handle these articles. In order to shift the location of the null points, one rotates the sun disc about its eccentric axis, which happens to be the axis of rotation of the wheel 58 itself. To effect that rotation the screw 258 first is loosened and thereafter, hex nut 250 is loosened. As illustrated, the sun disc 246 is mounted to place the screw 258 midway between the ends of slot 256. Since only one half the length of the slot 256 is used, so that the screw is shown at one extreme of its usable path in slot 256. The sun disc 246 is can be rotated counterclockwise about said eccentric axis changing the center to center distance between the center line of the sun disc and axis of the planet wheel 306. As illustrated in FIG. 9, and as apparent from the previous discussion, the null condition occurs when the center of the planet wheel 306, the center of the sun disc 246 and the center of the wheel 58 are in alignment. It so happens that the center of the wheel 58 is the eccentric mounting point of disc 246 (at the bolt 250). By rotating the sun disc 246 (after loosening same), its center point may be moved relative the other two center points mentioned, and of course, relative to the latch at 240, 232. In this way the pair of null points (which are 180° apart) can be moved or relocated relative to the latch point so that the condition is avoided where the article to be printed drives the wheel 58 to a null point from which the wheel neither properly continues to or returns to its corrected starting point when released from said article. Accordingly, the null condition along the springs 314, 316 can be shifted relative to the latch whereby to permit articles of the said intermediate length to be imprinted. Shifting the first null location, also shifts the second null location and effectively increases the torque applied to bias the latch into latched condition. It is believed that the torque can be doubled where the disc 246 is rotated a maximum of 45° in making the adjustment, giving latch bias of 75°.

Only about half of slot 256 is utilized. The remaining portion of the slot is provided so that adjustment can be made for use on the opposite side of the conveyor, along with changes in orientation of the pawl 318, latch plate 236 and the spring 334 which also are effected so that the wheel assembly 58 may be utilized in the aforementioned opposite mode.

It will be noted that two endless springs 314 and 316 have been provided for coupling the planet wheel and sun disc. Both springs would be used where the reaction time for return of the imprinting wheel assembly to the given start position is that encountered during ordinary speed conveying systems, or where closer spacing of the articles is encountered. Should the conveyor with which the device 10 is associated operate at a slower rate, only one endless spring need is required since the force required to return the imprinting wheel assembly to the given start condition substantially is reduced whereby the operating life of the friction driving rings is increased.

It should be understood that although the base-lock type-retaining rings were illustrated, any available type carriers, such as those holding logo-type, matt-type etc., can be utilized so long as the key is provided thereon to effect the slot and key coupling contemplated by the invention.

Suitable spacers (not shown) can be mounted to the planet and pawl studs 272 and 280 to enable use of wider imprinting wheel assemblies.

The device 10 can be provided with a structure such as disclosed in U.S. Pat. No. 3,122,993 which will prevent the imprinting wheel assembly from rotating through greater than 360° when it is used with articles whose length is greater than the circumference of said imprinting wheel.

What I claim is:

1. In a rotary article marking device for applying imprinted information upon articles traveling spaced apart along the path of a conveyor past said device, said device including base means, a hollow imprinting wheel carrying imprinting means thereupon and supported on said base means for rotary movement, an inking wheel supported for free rotary movement relative said base means, said inking wheel being engageable with said imprinting wheel, support means for mounting said base means proximate said path, mounting means for securing said base means for limited angular pivotal rotation about said support means, first biasing means biasing said base means in said path to position said imprinting wheel into intercepting condition relative to the path of the articles to be imprinted, stop means for limiting said angular pivotal rotation of said base means, drive means on the imprinting wheel positively engaging said surface of an article frictionally to rotate said imprinting wheel; the improvement comprising, means within said imprinting wheel for placing said imprinting wheel in a given initiate rotational orientation prior to interception of an article, said last mentioned means comprising a spring-biased sun and planet arrangement mounted fully within the imprinting wheel, said sun and planet arrangement defined by a stationary circumferentially grooved sun disc mounted eccentrically at the axis of rotation of the imprinting wheel, a circumferentially grooved planet wheel secured to the interior of said imprinting wheel for movement along a generally circular path about said sun disc with the rotation of the imprinting wheel and endless spring means looped about said sun disc and planet wheel, a stationary latch member and said sun disc secured thereto at a point eccentric to the center of said sun disc, a pawl member secured within said imprinting wheel at a location diametrically opposite to the location of said planet wheel and being movable along said circular path simultaneous with movement of said planet wheel and a spring biasing said pawl member to intercept said stationary latch member, the spacing relationship between said sun disc and planet wheel being selected to enable said endless spring means to exert a torque upon the imprinting wheel positively to engage said latch member at the initiate orientation and to maintain said engagement in positive latch-pawl engagement at said initiate orientation and further operable automatically to return said imprinting wheel to said initiate orientation upon release of said imprinting wheel from the article subsequent to application of an imprint, said return being substantially independent of the extent of rotation of said imprinting wheel.

2. The device as claimed in claim 1 in which said planet wheel is positioned to apply an angular bias opposite to the direction of rotation of said imprinting wheel, said disc being capable of being selectively rotated about its eccentric mounting axis to change the applied bias.

3. The device as claimed in claim 1 in which a predetermined angular torque is applied to the imprinting wheel to maintain a biased latch-pawl engagement with the sun disc capable of being rotated no less than about 20° and no more than about 75° about its eccentric mounting axis relative to its rotative orientation at the minimum extension of said endless spring means whereby to selectively change the applied angular torque.

4. The device as claimed in claim 1 wherein said stationary disc and said planet wheel each have at least one annular groove and said endless spring means comprise an endless spring seated in said grooves.

5. The device as claimed in claim 1 in which said stationary disc and said planet wheel each have at least two annular grooves and said endless spring means comprise at least one endless spring seated within at least one set of said grooves.

6. The device as claimed in claim 1 in which said imprinting wheel has a cylindrical wall, ring means, including type retaining rings and at least one drive ring, slidably received on said cylindrical wall, ring retaining means threadably engaged upon said cylindrical wall and slot and key means carried respectively by said ring means and cylindrical wall for restraining said ring means against relative rotational movement during rotation of the imprinting wheel.

7. The device as claimed in claim 6 in which said slot and key means comprise at least one rib formed on the inner edge of said ring means and said cylindrical wall has at least one matching longitudinal groove formed therein extending substantially coextensive therewith.

8. The device as claimed in claim 1 and means accessible from the exterior of said base means for shifting the center to center distance between the inking wheel and the imprinting wheel, said means comprising a mounting bracket releasably secured to the undersurface of said base means, said inking wheel secured to said mounting bracket, said bracket arranged for limited slidable movement along said base means and a cam operable upon said bracket to effect said movement.

9. The device as claimed in claim 1 and a housing, said base means being unitary with said housing and forming the floor thereof, a shield portion unitary with said housing and formed along the edge of said base means coextensive therewith and including an upright wall, a cover seated upon said shield to define an enclosure, a portion of said base means extending outward of said enclosure and said imprinting wheel mounted to said portion with the remaining elements disposed within said enclosure.

10. The device as claimed in claim 9 in which the base means comprise a metal plate and the upright wall of the housing is molded on the said metal plate.

11. In a rotary article marking device for applying imprinted information upon articles traveling spaced apart along the path of a conveyor past said device, said device including base means, a hollow imprinting wheel carrying imprinting means thereupon and supported on said base means for rotary movement, an inking wheel supported for free rotary movement relative said base means, said inking wheel being engageable with said imprinting wheel, support means for mounting said base means proximate said path, mounting means for securing said base means for limited angular pivotal rotation about said support means, first biasing means biasing said base means in said path to position said imprinting wheel into intercepting condition relative to the path of the articles to be imprinted, stop means for limiting said angular pivotal rotation of said base means, drive means on the imprinting wheel positively engaging said surface of an article frictionally to rotate said imprinting wheel; the improvement comprising, means within said imprinting wheel for placing said imprinting wheel in a given initiate rotational orientation prior to interception of an article, said last mentioned means comprising a spring-biased sun and planet arrangement mounted fully within the imprinting wheel, said sun and planet arrangement defined by a stationary circumferentially grooved sun disc mounted eccentrically at the axis of rotation of the imprinting wheel, a circumferentially grooved planet wheel secured to the interior of said imprinting wheel for movement along a generally circular path about said sun disc with the rotation of the imprinting wheel and endless spring means looped about said sun disc and planet wheel, a stationary latch member and said sun disc secured thereto at a point eccentric to the center of said sun disc, a pawl member secured within said imprinting wheel at a location diametrically opposite to the location of said planet wheel and being movable along said circular path simultaneous with movement of said planet wheel and a spring biasing said pawl member to intercept said stationary latch member, the spacing relationship between said sun disc and planet wheel being selected to enable said endless spring means to exert a torque upon the imprinting wheel positively to engage said latch member at the initiate orientation and to maintain said engagement in positive latch-pawl engagement at said initiate orientation and further operable automatically to return said imprinting wheel to said initiate orientation upon release of said imprinting wheel from the article subsequent to application of an imprint, said return being substantially independent of the extent of rotation of said imprinting wheel and said imprinting wheel is rotatable through a first null condition where the endless spring means are minimally extended and a second null condition where the endless spring means has maximum extension to define said null conditions, said initiate orientation having the planet wheel rotatably offset a predetermined angular rotation from its disposition in said first null condition.

12. The device as claimed in claim 11 in which said null conditions occur when the eccentric axis of said stationary disc, the axis of rotation of the wheel and the center axis of said planet wheel lie along a straight line.

13. The device as claimed in claim 8 in which said second null condition coincides with a maximum rotation of the imprinting wheel short of the latched condition and the first null condition occurs with a minimal rotation of said imprinting wheel from the latched condition.

14. The device as claimed in claim 11 in which said sun disc is capable of being selectively rotated about its eccentric axis and then secured in place whereby to adjust the angular torque applied to the imprinting wheel at the latched initiate condition thereby to shift the angular disposition of the wheel at which said pair of null conditions respectively occur.

15. The device as claimed in claim 14 in which said sun disc has an arcuate slot formed therein along a line coaxial with its eccentric axis and a releasable fastener seated in said slot and secured therethrough to said latch whereby release of the fastener permits selective rotation of said disc about its eccentric axis, said fastener and said disc being returned thereafter to their fixedly secured condition.

16. In a rotary article marking device for applying imprinted information upon articles traveling spaced apart along the path of a conveyor past said device, said device including base means, an imprinting wheel carrying imprinting means thereupon and supported on said base means for rotary movement, first friction drive means carried by said imprinting wheel and engageable with the surface of the article to which an imprint is to be applied, an inking wheel carrying inking means and supported for free rotary movement relative said base means, said inking wheel being engageable with said imprinting wheel, support means for mounting said base means proximate said path, mounting means for securing said base means for limited angular pivotai rotation about said support means, first biasing means biasing said base means in said path to position said imprinting wheel into intercepting condition relative to the path of the articles to be imprinted, stop means for limiting said angular pivotal rotation of said base means, said first friction drive means positively engaging said surface of an article frictionally to rotate said imprinting wheel and positioning means, including latch means, mounted within said imprinting wheel for placing said imprinting wheel at a given starting position when said first friction drive means is released by said article; the improvement comprising: said positioning means comprising a grooved stationary disc, a planet wheel arranged to move with rotation of the imprinting wheel in an orbital path about said disc and endless spring means looped about said disc and planet wheel whereby to define a spring biased sun and planet arrangement operable to apply a predetermined angular torque to said imprinting wheel for maintaining said imprinting wheel in latched starting condition and further operable automatically to return said imprinting wheel to the latched starting condition upon release of said imprinting wheel from the article subsequent to application of an imprint thereon and said support means for mounting said base means comprise a unitary spider formation including a tubular portion capable of receiving a shaft therethrough, a pair of outwardly extending legs and a post angularly spaced from said legs, said legs and post being coextensive with the tubular portion, each of said legs and said post having an outwardly opening threaded groove capable of receiving fastening means in the ends thereof for securing said spider formation to said base means, the opposite ends of said spider formation being planar whereby to define a three point support when installed.

17. In a rotary article marking device for applying imprinted information upon articles traveling spaced apart along the path of a conveyor past said device, said device including base means, a hollow imprinting wheel carrying imprinting means thereupon and supported on said base means for rotary movement, an inking wheel supported for free rotary movement relative said base means, said inking wheel being engageable with said imprinting wheel, support means for mounting said base means proximate said path, mounting means for securing said base means for limited angular pivotal rotation about said support means, first biasing means biasing said base means in said path to position said imprinting wheel into intercepting condition relative to the path of the articles to be imprinted, stop means for limiting said angular pivotal rotation of said base means, drive means on the imprinting wheel positively engaging said surface of an article frictionally to rotate said imprinting wheel; the improvement comprising, means within said imprinting wheel for placing said imprinting wheel in a given initiate rotational orientation prior to interception of an article, said last mentioned means comprising a spring-biased sun and planet arrangement mounted fully within the imprinting wheel, said sun and planet arrangement defined by a stationary circumferentially grooved sun disc mounted eccentrically at the axis of rotation of the imprinting wheel, a circumferentially grooved planet wheel secured to the interior of said imprinting wheel for movement along a generally circular path about said sun disc with the rotation of the imprinting wheel and endless spring means looped about said sun disc and planet wheel, a stationary latch member and said sun disc secured thereto at a point eccentric to the center of said sun disc, a pawl member secured within said imprinting wheel at a location diametrically opposite to the location of said planet wheel and being movable along said circular path simultaneous with movement of said planet wheel and a spring biasing said pawl member to intercept said stationary latch member, the spacing relationship between said sun disc and planet wheel being selected to enable said endless spring means to exert a torque upon the imprinting wheel positively to engage said latch member at the initiate orientation and to maintain said engagement in positive latch-pawl engagement at said initiate orientation and further operable automatically to return said imprinting wheel to said initiate orientation upon release of said imprinting wheel from the article subsequent to application of an imprint, said return being substantially independent of the extent of rotation of said imprinting wheel and said inking wheel comprises a spindle to enable free rotation of said inking wheel relative to the base means, said spindle secured to the base means, a drive assembly including, a drive ring, a hub portion secured to said drive ring, said hub portion capable of slidable engagement upon said spindle and an inking ring carried by said hub, and quick coupling means comprising a spring follower arranged on said drive ring in interference relationship to the slidable engagement of said hub upon said spindle and cam means formed on said spindle, retainer means formed on said hub and said spindle, said cam means operating to displace said spring follower during engagement of said drive assembly upon said spindle and said follower thereafter being seated in said retainer means for maintaining the coupling therebetween.

18. The device as claimed in claim 17 wherein said inking wheel is spring loaded.

19. The device as claimed in claim 17 in which the base means comprise a metal plate and the upright wall of the housing is molded on the said metal plate to define a unitary shield therefor.

20. The device as claimed in claim 17 in which the cam means comprise a chamfered end formed on the spindle, said hub has an enlarged knurled end portion and said retainer means comprise an annular groove formed in said spindle and a chordal slot formed in said knurled end portion and aligned with said annular groove when the hub is engaged fully upon said spindle, said spring follower being received through said slot within said groove.

21. In a rotary article marking device for applying imprinted information upon articles traveling spaced apart along the path of a conveyor past said device, said device including base means, an imprinting wheel carrying imprinting means thereupon and supported on said base means for rotary movement, first friction drive means carried by said imprinting wheel and engageable with the surface of the article to which an imprint is to be applied, an inking wheel carrying inking means and supported for free rotary movement relative said base means, said inking wheel being engageable with said imprinting wheel, support means for mounting said base means proximate said path, mounting means for securing said base means for limited angular pivotal rotation about said support means, first biasing means biasing said base means in said path to position said imprinting wheel into intercepting condition relative to the path of the articles to be imprinted, stop means for limiting said angular pivotal rotation of said base means, said first friction drive means positively engaging said surface of an article frictionally to rotate said imprinting wheel and positioning means, including latch means, mounted within said imprinting wheel for placing said imprinting wheel at a given starting position when said first friction drive means is released by said article; the improvement comprising: said positioning means comprising a grooved stationary disc, a planet wheel arranged to move in an orbital path about said disc with the rotation of the imprinting wheel and endless spring means looped about said disc and planet wheel whereby to define a spring biased sun and planet arrangement operable to apply a predetermined angular torque to said imprinting wheel for maintaining said imprinting wheel in latched starting condition and further operable automatically to return said imprinting wheel to the latched starting condition upon release of said imprinting wheel from the article subsequent to application of an imprint thereon and said support means for mounting said base means include a unitary spider formation having a hub provided with an axial passage and a pair of outwardly extending walls coextensive with said hub, each of said walls terminating in a longitudinal outwardly opening threaded groove, a post intermediate said walls formed along said hub at a location distantly spaced from said walls and said post having a longitudinal groove formed therein coextensive therewith, said spider formation having planar opposite ends and being seated on said base means within said housing and fastening means engageable within said grooves for securing said spider formation to said base means, said hub adapted to receive a shaft therethrough for limited pivotal movement of said hub thereabout.

22. In a rotary friction driven imprinting device for use in imprinting information upon the surface of successive articles traveling spaced along a given path, said device including a cylinder carrying imprinting means thereupon, latch means for determining a given start position of said device and means biasing said device into latched condition; the improvement comprising planetary repositioning means for applying an angular torque to said device positively to maintain said latched condition until the device is rotated by engagement with an article, said repositioning means comprising, a stationary disc mounted eccentrically upon the rotational axis of said device and having said latch means secured thereto, a planet wheel mounted to said device for rotation therewith in a path orbiting said stationary disc, a pawl including a latch engaging portion mounted to said device spaced from said planet wheel, means biasing the latch-engaging portion of said pawl into engagement with said latch means, matching groove means formed in said disc and said planet wheel and endless spring means looped about said disc and planet wheel and seated within said groove means, rotation of said device releasing said latch and causing said planet wheel and said pawl to orbit said disc extending said endless spring means to apply said angular torque of a magnitude sufficient to return said device to its starting position when said device has rotated through less than 360° substantially independently of the extent of rotation thereof and said endless spring means has maximum and minimum extension conditions, the torque at those conditions being insufficient to reestablish a latched start condition, said disc being rotatable selectively about its eccentric mounting axis to change the locations of said extension conditions relative to said latch thereby varying the extent of rotation of said device required to reach said extension conditions, the extent of rotation of said device being dependent upon the length of the article being imprinted.

23. The device as claimed in claim 22 in which said endless spring means comprise a pair of endless springs, and said groove means comprise a pair of annular grooves formed in each of said disc and planet wheel.

24. The device as claimed in claim 22 in which said endless spring means comprises at least one endless spring and said groove means comprises at least one annular groove formed in each of said disc and planet wheel respectively.

25. A rotary imprinting device for use in imprinting information upon the surface of successive articles traveling during frictional engagement of said device upon said surface spaced along a given path and comprising a hollow open-topped cylinder having a floor and an upstanding hub portion formed centrally in said floor adapted to receive an axle seated therein to enable free rotation of said cylinder thereabout, repositioning means within said cylinder for returning the cylinder to a given starting position, said repositioning means capable of exerting a positive bias to the wheel to define said starting position, cover means releasably secured over the top of said cylinder, imprinting means, ring means for carrying said imprinting means, friction drive means capable of frictionally engaging the surface of the article to be imprinted to rotate the device, said ring means and said friction drive means being slidably mounted on the exterior exterior of said cylinder for retaining said ring means and friction drive means upon said cylinder and a slot and key coupling between said cylinder and said ring means and said friction drive means preventing relative rotation thereof during operation of said device and said repositioning means comprise an eccentrically mounted stationary disc secured to said axle and carrying a radially extending latch, a planet wheel mounted to the interior of said cylinder coplanar with said disc, each of said disc and planet wheel having annular groove means, pawl means including a latch-engaging portion mounted to the interior of said cylinder spaced from said planet wheel, means biasing said latch-engaging portion normally toward said latch, endless spring means looped about said disc and planet wheel coupling same, said planet wheel and pawl being movable in a path about said disc with rotation of said cylinder, said planet wheel being positioned relative to said latch at a location establishing a biasing torque upon said cylinder for maintaining a latched condition establishing said given starting position of said cylinder, said planet wheel being movable with rotation of said cylinder through two null conditions at which said endless spring means are at maximum and minimum extension, said null conditions being conditions of balance whereat there is insufficient torque applied to the wheel to cause self-return thereof to the said given starting position and means for shifting said null conditions to change the locations thereof relative to the latch whereby to adjust the response of the positioning means to different length articles, the disc being rotated to a condition whereat the endless spring means are between maximum and minimum expansion at the initiate condition of the cylinder whereby to provide said biasing torque.

26. The rotary imprinting device as claimed in claim 25 in which said means for shifting the location of said null conditions relative to the latch comprise means enabling rotation of said disc selectively about its eccentric axis whereby to change the relationship of the center axis of said disc relative to the center axis of the planet wheel.

27. The rotary imprinting device as claimed in claim 26 in which said enabling means comprise a releasable mounting at the eccentric axis of said disc, an arcuate slot formed in said disc radially spaced from said eccentric axis and along an arc concentric therewith, releasable fastening means seated within said slot for immobilizing said disc, said fastening means capable of being loosened to permit rotation of said disc about said eccentric axis whereby the relationship of the center of said disc to the center of said planet wheel is changed, thereby to change the location of the null conditions relative to the latch.

28. The device as claimed in claim 25 in which there are means to adjust the angular torque applied to the imprinting wheel at the latched condition thereby to shift the angular disposition of the wheel at which the said null conditions occur.

29. The device as claimed in claim 28 in which said adjustment means comprise means to enable selective rotation of said disc about its eccentric axis.

30. The device as claimed in claim 29 in which said last mentioned means comprise an arcuate slot formed in said disc along a line coaxial with said eccentric axis and fastening means seated in said slot, said disc being releasably secured to said imprinting wheel whereby to permit selective rotation of said disc about its eccentric axis, said fastening means and said disc being returned to their fixedly secured condition subsequent to rotation of said disc a selected angular distance.

31. The structure as claimed in claim 29 wherein the inking wheel is friction driven.

32. A rotary imprinting device for use in imprinting information upon the surface of successive articles traveling during frictional engagement of said device upon said surface spaced along a given path and comprising a hollow open-topped cylinder having a floor and an upstanding hub portion formed centrally in said floor adapted to receive an axle seated therein to enable free rotation of said cylinder thereabout, repositioning means within said cylinder for returning the cylinder to a given starting position, said repositioning means capable of exerting a positive bias to the wheel to define said starting position, cover means releasably secured over the top of said cylinder, imprinting means, ring means for carrying said imprinting means, friction drive means capable of frictionally engaging the surface of the article to be imprinted to rotate the device, said ring means and said friction drive means being slidably mounted on the exterior of said cylinder, retainer means threadably mounted upon the exterior of said cylinder for retaining said ring means and friction drive means upon said cylinder and a slot and key coupling between said cylinder and said ring means and said friction drive means preventing relative rotation thereof during operation of said device and in which said inking wheel comprises a spindle mounted for free rotation relative to the base means, an annular ring having a rim, a hub portion secured to said annular ring, said hub portion capable of slidable engagement upon said spindle and an inking ring carried by said hub, and quick coupling means carried by said spindle and ring, said quick-coupling means comprising a spring follower arranged on said ring in interfering relationship to the slidable engagement of said hub upon said spindle and cam means formed on said spindle, retainer means formed on said hub and said spindle, said cam means operating to displace said spring follower during engagement of said drive assembly upon said spindle and said follower thereafter being seated in said retainer means for maintaining the coupling.

33. In a friction driven rotary article marking device for applying imprinted information upon articles such as packages, cartons and the like as same travel spaced apart successively along the path of a conveyor past said device and including a friction driven imprinting wheel, an inking wheel capable of applying ink to said imprinting wheel, a spring biased base plate and means coupling means imprinting wheels relative to the base plate for free rotation of said wheels about their respective axes, drive means carried by said imprinting wheel and imprinting means carried by said imprinting wheel, means mounting said base plate pivotally to place said drive means into the path of said articles so as individually to intercept same and rotate along said article thereby to rotate said imprinting wheel continuous with such engagement; the improvement comprising, means within said imprinting wheel for placing said imprinting wheel in a given initiate rotational orientation prior to interception of an article, said last mentioned means comprising a spring-biased sun and planet arrangement mounted fully within the imprinting wheel, said sun and planet arrangement defined by a stationary circumferentially grooved sun disc mounted eccentrically at the axis of rotation of the imprinting wheel, a circumferentially grooved planet wheel secured to the interior of said imprinting wheel for movement along a generally circular path with the rotation of the imprinting wheel and endless spring means looped about said sun disc and planet wheel, a stationary latch member mounted at the axis of rotation of the imprinting wheel, said sun disc secured to said stationary latch member eccentric relative to its center point, a pawl member secured within said imprinting wheel at a location diametrically opposite to the location of said planet wheel and being movable along said circular path simultaneous with movement of said planet wheel and a spring biasing said pawl member to intercept said stationary latch member, the spacing relationship between said sun disc and planet wheel being selected to enable said endless spring means to exert a torque upon the imprinting wheel positively to engage said latch member at the initiate orientation and maintain said engagement in positive latch-pawl engagement at its initiate orientation and further operable automatically to return said imprinting wheel to said orientation upon release of said imprinting wheel from the article subsequent to application of an imprint substantially independent of the extent of rotation of said imprinting wheel, said planet wheel being secured to the interior of said imprinting wheel for its orbital movement and means for adjusting the relative position of said disc and said planet wheel to change the location of the maximum and minimum expansion conditions of the endless spring whereby to change the location of the null conditions of the planet wheel and endless spring relative to the latch member.

34. The structure as claimed in claim 33 in which said imprinting means comprise type-holding ring means seated upon said imprinting wheel and imprinting type means seated on said type-holding means, said drive means comprising at least one drive also seated upon said imprinting wheel and a slot and key coupling between said type-holding means and said drive ring on the one hand and said imprinting wheel on the other hand, for retaining said type-holding ring means and said drive ring against independent rotation relative to said imprinting wheel during operation.

35. The structure as claimed in claim 33 in which said adjusting means comprise an arcuate slot formed in said disc along an arc concentric with the eccentric axis of said disc and a releasable fastener secured in said slot, temporary loosening of said fastener permitting limited rotation of said disc about its eccentric axis so that the center to center distance between the disc and the planet wheel is varied.

36. The structure as claimed in claim 33 and a molded housing enclosing all but said imprinting wheel, said molded housing including said base plate as unitary part thereof.

* * * * *